US006220238B1

(12) United States Patent
Boudreault

(10) Patent No.: US 6,220,238 B1
(45) Date of Patent: Apr. 24, 2001

(54) MODULAR GREASE EXTRACTOR

(76) Inventor: Jean-Pierre Boudreault, 3839 Rachel, Montréal (Québec) (CA), H1X 1Y7

( * ) Notice: Subject to any disclaimer, the term of this patent is extended or adjusted under 35 U.S.C. 154(b) by 0 days.

(21) Appl. No.: 09/492,087

(22) Filed: Jan. 27, 2000

(51) Int. Cl.[7] ..... F24C 15/20
(52) U.S. Cl. ..... 126/299 R; 126/299 D; 55/DIG. 36
(58) Field of Search ..... 126/299 R, 299 D, 126/300, 299 E, 21 R, 21 A; 55/DIG. 36; 454/67, 49, 58, 63, 65

(56) References Cited

U.S. PATENT DOCUMENTS 3,364,664 * 1/1968 Doane ..... 126/299 D
5,042,457 * 8/1991 Gallagher ..... 126/299 E
5,540,214 * 7/1996 Boudreaulat ..... 126/299 E
5,960,786 * 10/1999 Lambertson ..... 126/299 D

* cited by examiner

*Primary Examiner*—James C. Yeung
(74) *Attorney, Agent, or Firm*—Swabey Ogilvy Renault

(57) ABSTRACT

The modular grease extractor is of the type to be used for replacing filters in an assembly which utilises a plurality of filters to accommodate grease extracting needs for various air flow generated by each cooking appliance. The extractor comprises a hopper shaped member which is opened at a wide end and is terminated by at least one opening at a narrow end thereof. The hopper shaped member has a front panel and a rear panel, and lateral sides joining the front and rear panels, thereby defining a grease extracting chamber. A sliding member is provided between the lateral sides to divide the grease extracting chamber into an entrance portion and an exit portion of the grease extracting chamber and to provide a variable communication between the entrance portion and the exit portion depending on the extent of penetration of the sliding member into the grease extracting chamber.

14 Claims, 5 Drawing Sheets

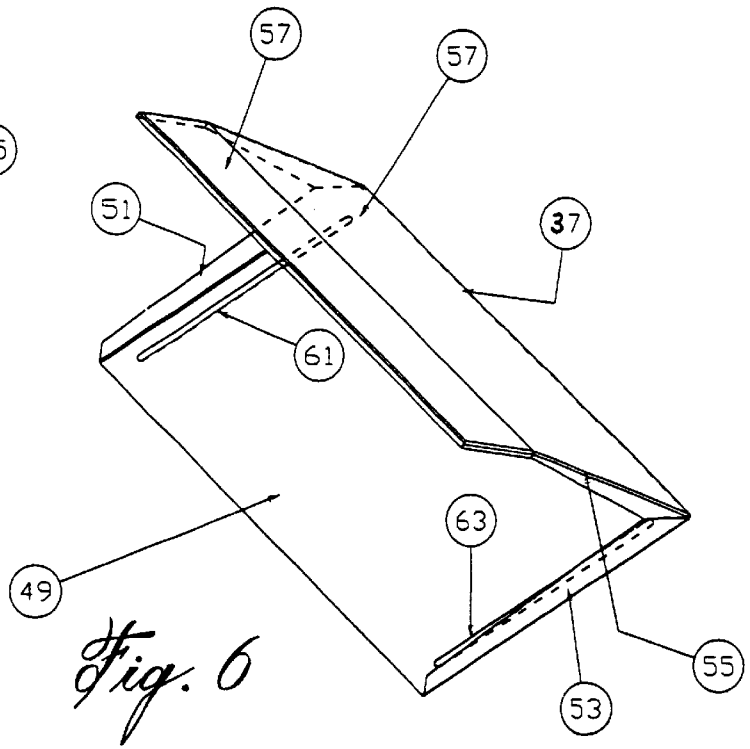
Fig. 6
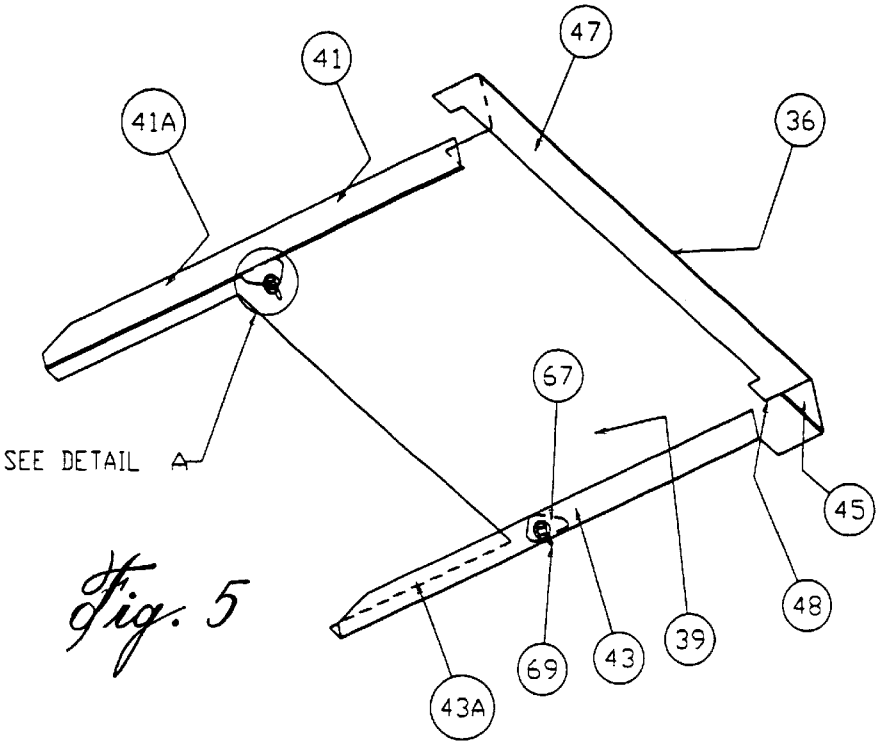
Fig. 5
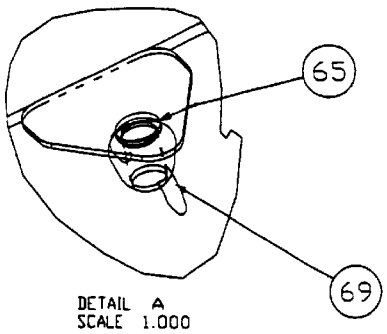

MODULAR GREASE EXTRACTOR

BACKGROUND OF INVENTION (a) Field of the Invention

The present invention relates to a high efficiency modular grease extractor, more particularly of the type to be used for replacing standard filters of all shapes and sizes in a cooking assembly which utilises a plurality of such standard filters. The modular grease extractor according to the invention is a liquid tight enclosure which is used in order to drain out condensates or any liquid detergent or other liquid or solution that may be sprayed inside the enclosure in order to clean or deodorize the interior of the modular grease extractor.

(b) Description of Prior Art

In a large number of cooking assemblies, various heating elements are used for different purposes, wherein the filtering capacity of the grease extractor need not be the same. However, since the standard filters which are used in a multi-unit are always the same, it is not possible to vary the quantity of exhausted air. This of course means that an unnecessary amount of energy is often used by the exhaust unit and that the grease extracting units do not always function adequately, because the flow of air which is required to exhaust grease and fumes cannot be adequately adjusted.

It is therefore an object of the present invention to provide a modular grease extractor which can be adjusted to specific needs.

It is another object of the present invention to provide a modular grease extractor that can be used to replace standard filters in a cooking assembly and that can be fitted in the same place as the standard filters, wherein the filtering capacity for the various cooking units need not be the same.

It is another object of the present invention to provide a high efficiency modular grease extractor which can be designed with various sizes so as to fit into the space provided for any grease filter.

SUMMARY OF THE INVENTION

The above and other objects of the present invention may be achieved by providing a high efficiency modular grease extractor of the type to be used for replacing existing filters in a unit which utilises a plurality thereof to accommodate grease extracting needs for various air flows generated by each cooking appliance of the unit and which operate through a suction fan. The modular grease extractor comprises

- a hopper shaped member which is opened at a wide end and is terminated by at least one opening, for example a plurality of holes at a narrow end thereof,
- the hopper shaped member having a front panel and a rear panel, and lateral sides joining the front and rear panels, the hopper shaped member defining a grease extracting chamber,
- a sliding member having an upper end and a lower end,
- means for mounting the sliding member between the lateral sides to divide the grease extracting chamber into an entrance portion and an exit portion of the grease extracting chamber and to provide a variable communication between the entrance portion and the exit portion depending on the extent of penetration of the sliding member into the grease extracting chamber.

In accordance with a preferred embodiment, the mounting means comprise a middle panel member formed with lateral flanges and an uppermost flange at an upper end thereof, the middle panel member having sliding rails at a lower end thereof provided in the continuation of the lateral flanges, the sliding rails terminating short of the narrow end of the hopper shaped member, the middle panel member being fixedly mounted on the lateral sides of the hopper shaped member through the lateral flanges and the sliding rails, the sliding member being slidably mounted on the middle panel between the lateral flanges and onto the sliding rails so as to be movable between an uppermost position where the upper end of the sliding member abuts the uppermost flange, and a lowermost position wherein after sliding down between the lateral flanges and along the sliding rails, the lower end of the sliding member coincides with a location corresponding to the lower extremity of the sliding rails.

The sliding member preferably comprises a rectangular base, projecting borders provided on both lateral sides of the rectangular base, a main deflector at an end of the rectangular base corresponding to the upper end of the sliding member, the main deflector forming an acute angle with the rectangular base, and longitudinal slides cut in the rectangular base enabling to move the sliding member from the uppermost to the lowermost positions.

The high efficiency modular grease extractor preferably comprises studs mounted on the middle panel member to engage within the longitudinal slides, and means associated with the studs to tighten the sliding member in a preselected position according to the air flow requested over each cooking appliance of the unit.

The studs are preferably threaded and nuts are provided to screw over the studs while tightening the sliding member in a selected position relative to the middle panel member.

Preferably, the projecting borders regularly increase in height from bottom to top, to reinforce same, and are shaped to glide along the lateral flanges and the sliding rails as the sliding member is lowered or raised relative to the hopper shaped member. The front and rear panels preferably form an acute angle with respect to one another.

In accordance with another preferred embodiment, the front panel consists of a straight rectangular sheet and the rear panel consists of a bent rectangular sheet, the bent rectangular sheet forming an obtuse angle between a lower portion and an upper portion thereof.

The hopper shaped member preferably comprises a channel member provided at the bottom thereof.

In accordance with another embodiment, the main deflector angularly projects from the middle panel member in a manner to cause grease contained in an air flow circulating through the grease extracting chamber and produced by the suction fan, to be substantially entirely released in the grease extracting chamber by the action of centrifugal force, to be thereafter evacuated through the openings.

The main deflector is preferably terminated by a secondary deflector forming an obtuse angle with the main deflector.

In accordance with another embodiment, the uppermost flange is in the form of a rectangular channel having the same cross-section as the channel member, the rectangular channel shaped uppermost flange being joined to the channel member by means of lateral rectangular channel shaped members fixed to the lateral sides, the channel member, the uppermost flange and the channel shaped lateral members thereby defining a frame enabling to handle the modular grease extractor.

BRIEF DESCRIPTION OF DRAWINGS

Other characteristics and advantages of the present invention will appear from the description which follows of an embodiment, which is given by way of illustration but without limitation and in which

FIG. 5 is a perspective view of the middle panel member holding the sliding member;

FIG. 6 is a perspective view of the sliding member; and

DESCRIPTION OF PREFERRED EMBODIMENTS

Figure 2:
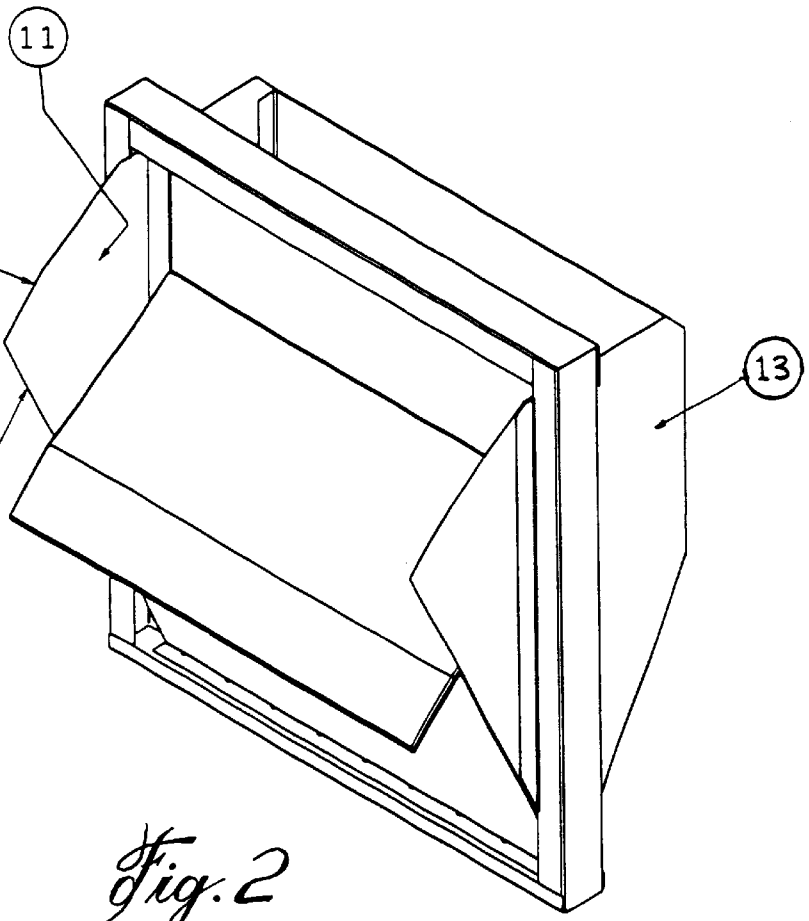
FIG. 2 is a perspective view of the modular grease extractor illustrated in FIG. 1 in the lowermost position of the sliding member.

With reference to the drawings, it will be seen that the modular grease extractor 1 which is illustrated, appears as a hopper shaped member 3, which as shown, is completely opened at its wide end and is terminated by openings 5 at its narrow end.

Hopper shaped member 3 is essentially made of a front panel 9 and a rear panel 7, which form an acute angle with respect to one another where they meet at the lower or narrow end of hopper shaped member 3. Hopper shaped member 3 is also made of lateral sides 11 and 13 which join both front and rear panels 9 and 7 to define a grease extracting chamber 15. All these elements of the hopper shaped member are joined together by any means known to those skilled in the art and which do not form part of the present invention.

More in detail, rear panel 7 is made of a straight rectangular sheet of material, such as stainless steel, which is preferred, although any other suitable material may be used as will be appreciated by one skilled in the art. With respect to front panel 9, as shown, it also consists of a rectangular sheet, preferably of the same material as rear panel 7, except that, as shown, it is nearly twice larger and is bent at 17 to define a lower portion 19 and an upper portion 21 which form an obtuse angle between one another. This angle could of course vary depending on the choice of the designer and the required efficiency of the device.

Figure 3:
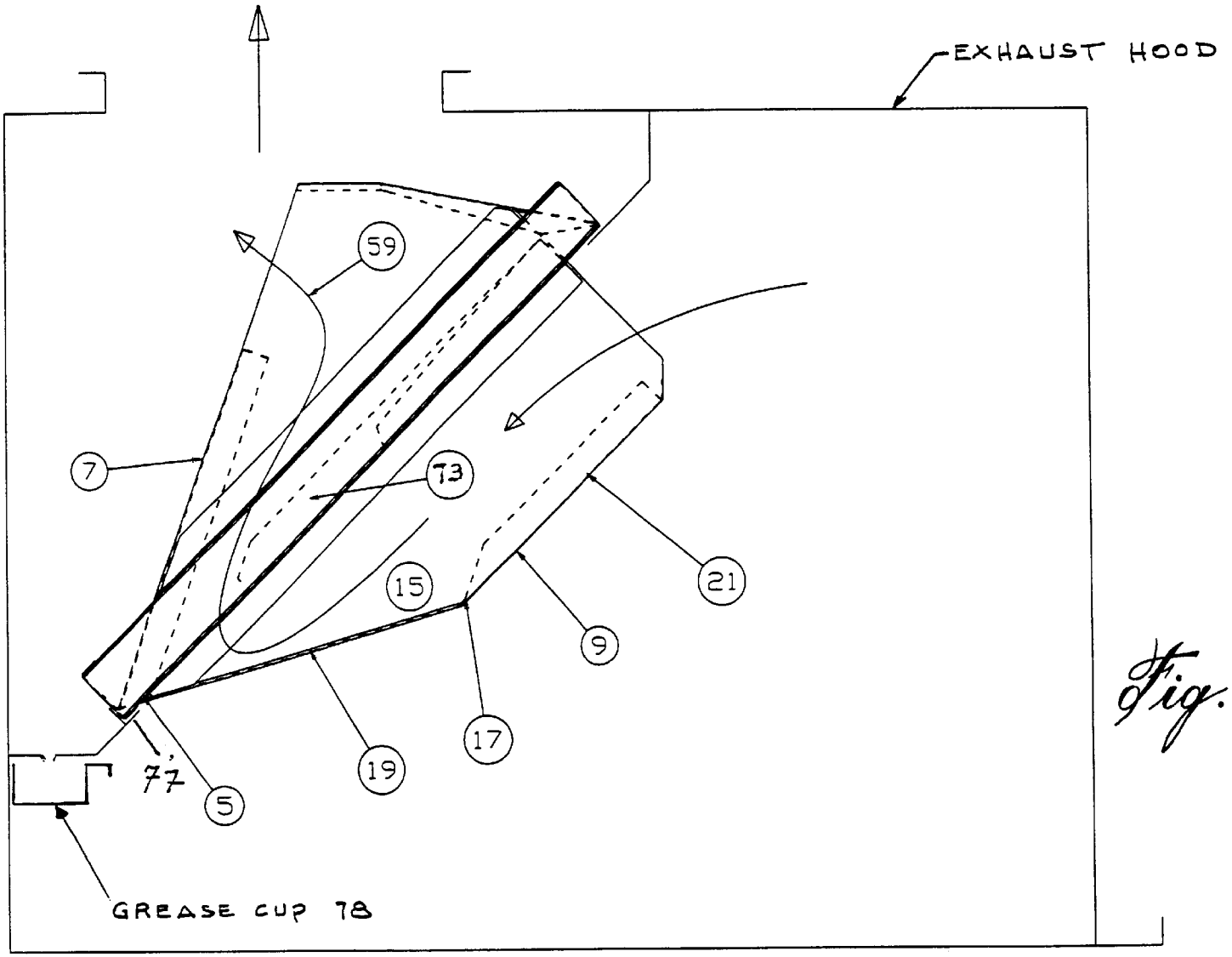
FIG. 3 is a schematic cross-section of the modular grease extractor illustrated in FIG. 1 shown in position in an exhaust hood, the position illustrated in FIG. 2 being shown in dotted lines.
Figure 4:
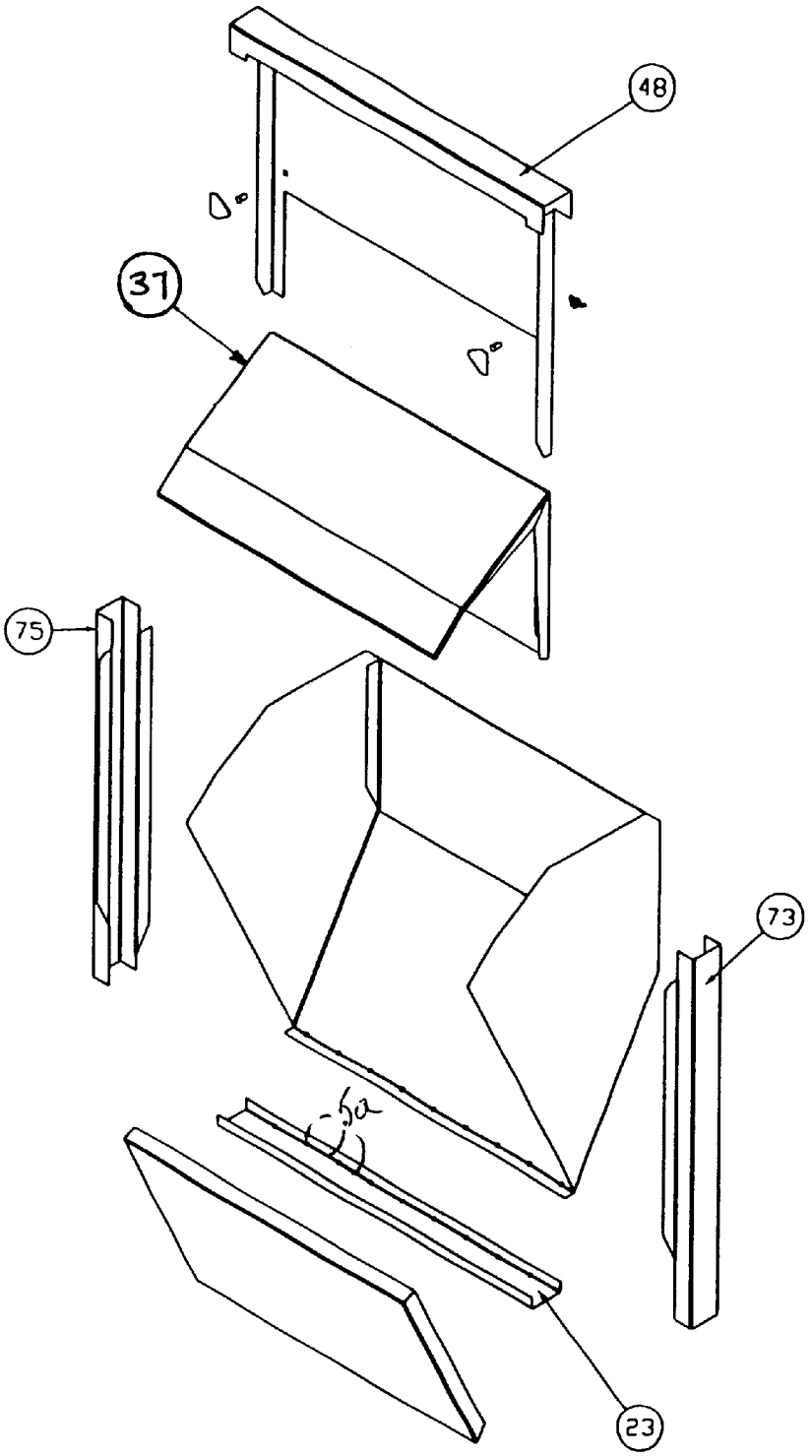
FIG. 4 is an exploded view of a modular grease extractor according to the invention.

It was mentioned above that hopper shaped member 3 is formed with openings 5 at its narrow end. It will be appreciated that openings 5 have only been schematically illustrated in the drawings and that their exact shape and detail is entirely left to one skilled in the art. It is understood that openings 5 are provided for the purpose of allowing grease condensates and any liquid which has been extracted in grease extracting chamber 15 to exit therefrom. To collect that grease condensate and liquid, a gutter 77 is used to deliver same to a grease cup 78 (FIG. 3).

Figure 7:
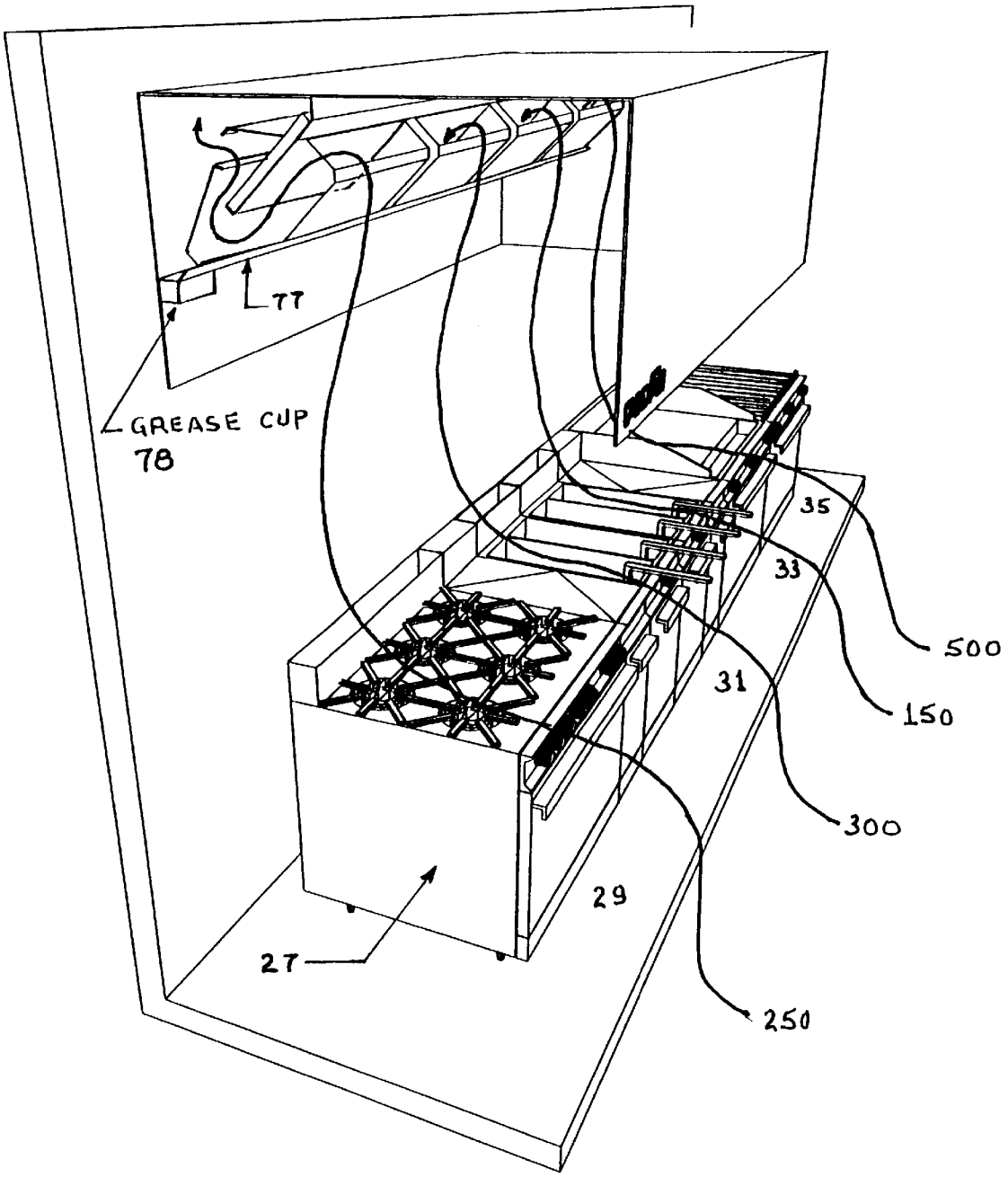
FIG. 7 is a perspective view of a cooking assembly including four units and an exhaust unit provided with modular grease extractors according to the invention.

The main characteristic of the invention as illustrated in the drawings, resides mostly in the provision of a sliding member 37 which permits to adjust the volume of air loaded with fumes and grease which is intended to be exhausted above a specific unit of a cooking assembly. For example, cooking assembly 27, which is illustrated in FIG. 7 of the drawings, has four different cooking units 29, 31, 33 and 35, which are all used for different purposes and wherein it is desirable to provide exhaust flows respectively of 250, 300, 150 and 500 $ft.^3$/min.

Sliding member 37 is mounted in middle panel member 36. More specifically, middle panel member 36 is formed of a rectangular sheet 39 having lateral flanges 41, 43, as shown, and an uppermost flange 45 having an in turned edge 47 forming a rectangular shaped member 48. Middle panel member 36 is mounted on hopper shaped member 3, inside grease extracting chamber 15 through lateral flanges 41, 43 and slide rail extensions thereof 41*a*, 43*a* which are fixed in known manner against lateral sides 11 and 13, such as by riveting or spot welding. It will also be noted that in practice, middle panel member 36 is disposed in hopper shaped member 3 so as to divide grease extracting chamber 15 in substantially equal parts, when sliding member 37 is mounted therein. In addition, it will be observed that middle panel member 36 has its lowermost end terminated well short of the narrow end of hopper shaped member.

Turning now to sliding member 37 per se, it will be seen that it consists of a rectangular base 49 having projecting borders 51 and 53, which are perpendicular to rectangular base 49 and extend all along both sides thereof. In addition, it will be observed that both borders 51, 53 regularly increase in height from the bottom to the top of rectangular base 49 to increase their strength, and are shaped to respectively glide along lateral flanges 41, 43 and slide rails 41A, 43B as sliding member is lowered or raised relative to hopper shaped member 3 as will be discussed more in detail hereinbelow.

Rectangular sheet 49 additionally includes a main deflector 55 at the top thereof as shown and a secondary deflector 57 projects from main deflector 55 at an obtuse angle so as to cause a deflection of the air which is sucked through the grease extracting chamber in the direction of arrow 59. Finally, rectangular base 49 of sliding member 37 is formed with a pair of parallel longitudinal slides 61, 63 which are cut into the material of rectangular base 49 as will be appreciated by one skilled in the art.

To enable sliding member 37 to be raised or lowered relative to hopper shaped member 3, middle panel member 36 is provided with a pair of threaded studs 65, 67 which are adapted to be engaged into longitudinal slides 61, 63. Wing nuts 69, 71 are used in the illustrated embodiment to screw over studs 65,67 to tighten sliding member 37 in a selected position, which can vary from lowermost where the flow of air is restricted to a minimum, to intermediate, to uppermost where the flow of air is opened to a maximum.

So, when a cooking unit requires an important flow of air, modular grease extractor 1 is adjusted in a corresponding fashion by raising sliding member 37 to provide a maximum distance between its lower end and the bottom or narrow end of hopper shaped member 3. Conversely, when a minimum flow of air is required, sliding member 37 is lowered to provide a minimum distance between the lower end of sliding member 37 and the bottom of hopper shaped member 3, all as shown in the drawings, particular FIGS. 1 and 2.

Figure 1:
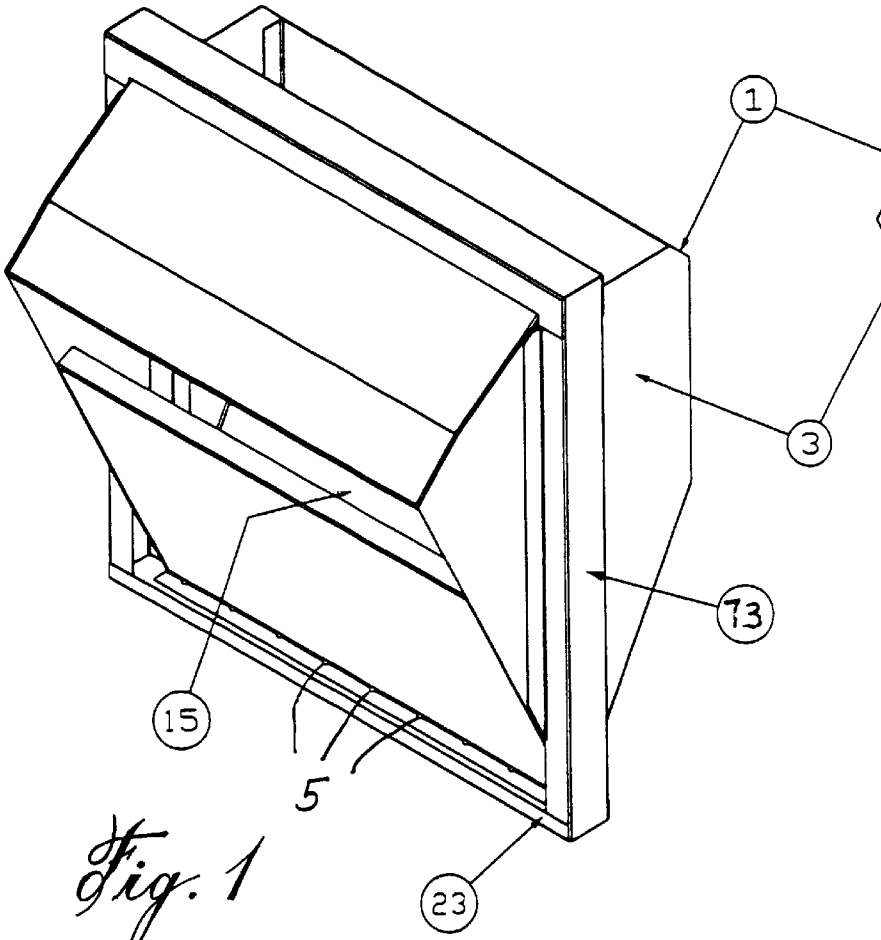
FIG. 1 is a perspective view of a modular grease extractor according to the invention, showing the uppermost position of the sliding member.

With reference to FIGS. 1, 2 and 3, it will be seen that hopper shaped member 3 is provided with a rectangular shaped member 23 with corresponding holes 5*a* immediately opposite longitudinal openings 5. Rectangular shaped members 48 and 23 are connected together by means of lateral rectangular shaped members 73, 75 to form a frame enabling to handle the modular grease extractor.

It is understood that modifications are possible without departing from the spirit and scope of the present invention.

I claim:

1. A high efficiency modular grease extractor of the type to be used for replacing existing filters in a unit which utilises a plurality thereof to accommodate various grease extracting needs for various air flows generated by each cooking appliance of said unit and which operate through a suction fan, said modular grease extractor comprising a hopper shaped member which is opened at a wide end and is terminated by at least one opening at a narrow end thereof, said hopper shaped member having a front panel and a rear panel, and lateral sides joining said front and rear panels, said hopper shaped member defining a grease extracting chamber, a sliding member having an upper end and a lower end, said sliding member comprising a rectangular base, and a main deflector at an end of said rectangular base corresponding to the upper end of said sliding member, said main deflector forming an acute angle with said rectangular base means for mounting said sliding member between said lateral sides to divide said grease extracting chamber into an entrance portion and an exit portion of said grease extracting chamber and to provide a variable communication between said entrance portion and said exit portion depending on extent of penetration of said sliding member into said grease extracting chamber, while simultaneously decreasing or increasing said entrance and said exit portions.

2. High efficiency modular grease extractor according to claim 1, wherein said mounting means comprise a middle panel member formed with lateral flanges and an uppermost flange at an upper end thereof, said middle panel member having sliding rails at a lower end thereof provided in the continuation of said lateral flanges, said sliding rails terminating short of said narrow end of said hopper shaped member, said middle panel member being fixedly mounted on the lateral sides of said hopper shaped member through said lateral flanges and said sliding rails, said sliding member being slidably mounted on said middle panel between said lateral flanges and onto said sliding rails so as to be movable between an uppermost position where the upper end of said sliding member abuts said uppermost flange, and a lowermost position wherein after sliding down between said lateral flanges and along said sliding rails, the lower end of said sliding member coincides with a location corresponding to lower extremity of said sliding rails.

3. High efficiency modular grease extractor according to claim 2, wherein said sliding member comprises projecting borders on both lateral sides of said rectangular base, and longitudinal slides cut in said rectangular base enabling to move said sliding member from said uppermost to said lowermost positions.

4. High efficiency modular grease extractor according to claim 3, which comprises studs mounted on said middle panel member to engage within said longitudinal slides, and means associated with said studs to tighten said sliding member in a preselected position according to the air flow requested over each cooking appliance of said unit.

5. High efficiency modular grease extractor according to claim 4, wherein said studs are threaded and nuts are provided to screw over said studs while tightening said sliding member in a selected position relative to said middle panel member.

6. High efficiency modular grease extractor according to claim 4, wherein said main deflector is terminated by a secondary deflector forming an obtuse angle with said main deflector.

7. High efficiency modular grease extractor according to claim 3, wherein said projecting borders regularly increase in height from bottom to top, to reinforce same, and are shaped to glide along said lateral flanges and said sliding rails as said sliding member is lowered or raised relative to said hopper shaped member.

8. High efficiency modular grease extractor according to claim 3, wherein said main deflector angularly projects from said middle panel member in a manner to cause grease contained in an air flow circulating through said grease extracting chamber and produced by the suction fan, to be substantially entirely released in said grease extracting chamber by action of centrifugal force, to be thereafter evacuated through said at least one opening.

9. A high efficiency modular grease extractor of the type to be used for replacing existing filters in a unit which utilizes a plurality thereof to accommodate grease extracting needs for various air flows generated by each cooking appliance of said unit and which operate through a suction fan, said modular grease extractor comprising a hopper shaped member, which is opened at a wide end and is terminated by at least one opening at a narrow end thereof, said hopper shaped member having a front panel and a rear panel, and lateral sides joining said front and rear panels, said hopper shaped member defining a grease extracting chamber, a sliding member having an upper end and a lower end, means for mounting said sliding member between said lateral sides, said mounting means comprising a middle panel member formed with lateral flanges, and an uppermost flange at an upper end thereof, said middle panel member having sliding rails at a lower end thereof provided in the continuation of said lateral flanges, said sliding rails terminating short of said narrow end of said hopper shaped member, said middle panel member being fixedly mounted on the lateral sides of said hopper shaped member through said lateral flanges and said sliding rails, said sliding member being slidably mounted on said middle panel member between said lateral flanges and onto said sliding rails, so as to be movable between an uppermost position where the upper end of said sliding member abuts said uppermost flange, and a lowermost position wherein after sliding down between said lateral flanges and along said sliding rails, the lower end of said sliding member coincides with a location corresponding to lower extremity of said sliding rails, said sliding member dividing said grease extracting chamber into an entrance portion and an exit portion of said grease extracting chamber to provide variable communication between said entrance portion and said exit portion depending on extent of penetration of said sliding member into said grease extracting chamber.

10. High efficiency modular grease extractor according to claim 9, wherein said front and rear panels form an acute angle with respect to one another.

11. High efficiency modular grease extractor according to claim 9, wherein said front panel consists of a straight rectangular sheet and said rear panel consists of a bent rectangular sheet, said bent rectangular sheet forming an obtuse angle between a lower portion and an upper portion thereof.

12. High efficiency modular grease extractor according to claim 9, wherein said hopper shaped member comprises a channel member provided at the bottom thereof.

13. High efficiency modular grease extractor according to claim 12, wherein said uppermost flange is in the form of a rectangular channel having the same cross-section as said channel member, said rectangular channel shaped uppermost flange being joined to said channel member by means of lateral rectangular channel shaped members fixed to said lateral sides, said channel member, said uppermost flange and said channel shaped lateral members defining a frame enabling to handle said modular grease extractor.

14. High efficiency modular grease extractor according to claim 9, wherein said at least one opening is in the form of a plurality of holes.

* * * * *